US005103738A

United States Patent [19]

Claussen

[11] Patent Number: 5,103,738

[45] Date of Patent: Apr. 14, 1992

[54] TRANSMISSION FOR MOVEMENT ALONG A TRACK SYSTEM

[76] Inventor: Jan Claussen, 6432 Sutherland Avenue, Powell River, British Columbia, Canada, V8A 4W4

[21] Appl. No.: 754,814

[22] Filed: Sep. 4, 1991

Related U.S. Application Data

[63] Continuation-in-part of Ser. No. 425,261, Oct. 23, 1989, which is a continuation-in-part of Ser. No. 180,841, Apr. 12, 1988, abandoned.

[51] Int. Cl.[5] ..... B61B 7/06

[52] U.S. Cl. ..... 104/204; 104/115; 104/112; 104/226; 105/30; 212/124

[58] Field of Search ..... 104/112, 115, 197, 204, 104/209, 214, 217, 226, 222, 180, 173.1, 87, 154; 105/30, 148; 212/124, 122

[56] References Cited

U.S. PATENT DOCUMENTS

| | | | |
|---|---|---|---|
| 330,807 | 11/1885 | Stout | 104/226 |
| 381,032 | 4/1888 | Roe | 104/226 |
| 404,500 | 6/1889 | Pendleton et al. | 104/226 |
| 507,887 | 10/1893 | Dean | 104/217 |
| 1,076,337 | 10/1913 | Vogel et al. | 104/115 |
| 1,087,063 | 2/1914 | Izett | 104/115 |
| 2,132,558 | 10/1938 | Braune et al. | 105/148 |
| 3,448,694 | 6/1969 | Seyfried | 105/30 |
| 3,767,025 | 10/1973 | Louis | 104/209 X |
| 4,512,259 | 4/1985 | DeKermadec | 104/226 X |

*Primary Examiner*—Margaret A. Focarino
*Assistant Examiner*—Joseph D. Pape

[57] ABSTRACT

A transmission for movement along a track system comprises a frame movably supported on the track system by guides mounted to the frame. At least one endless belt assembly comprising a pair of spaced endless belts engaging associated belt wheels is mounted to the frame. A drive system for rotating the belt wheels and driving the endless belt is provided. A gripping system adapted for holding and releasing the track system is mounted between the pair of spaced endless belt. The gripping system comprises a plurality of posts extending between the spaced endless belts over the length of the endless belt assembly with gripping units slidably mounted on each of the posts. Biasing springs tend to center the gripping units on the posts. An actuating arrangement is provided for activating the gripping system. The actuating arrangement defines a gripping region adjacent the track system and allows the gripping units to engage the track system upon entering the gripping region and release the track system on leaving the gripping region whereby the gripping units hold and release the track system in order that the transmission pulls itself along the track system. The transmission makes it possible to navigate turns in a track system, particularly a cable system.

20 Claims, 7 Drawing Sheets

TRANSMISSION FOR MOVEMENT ALONG A TRACK SYSTEM

CROSS-REFERENCE TO RELATED APPLICATIONS

This application is a continuation-in-part of U.S. patent application Ser. No. 425,261, filed Oct. 23, 1989, which is a continuation-in-part of U.S. patent application Ser. No. 180,841 filed Apr. 12, 1989, now abandoned which are incorporated herein by reference.

FIELD OF THE INVENTION

This invention relates to a transmission for movement along a track system, for example, a stationary suspended cable system in order to provide an alternative means of transportation. The transmission of the present invention finds particular application in, but is not limited to, the timber harvesting industry. This transmission may see use in any field where there is a need for transportation including such diverse fields as harvesting, agriculture and railways. The track system of the present invention can also use a single or two track multiple rail network or other similar guide means. The design of the transmission of the present invention permits it to navigate low radius turns to simplify and enlarge the possibilities for secure use of suspended cable systems.

BACKGROUND OF THE INVENTION

Transportation systems that use a transmission to drive a carriage along a track system are well known particularly when the track system used is some form of suspended cable arrangement.

Most prior art cable systems, however, employ a movable cable that is looped about rotating wheels at each end to provide propulsion to a car or other transport means mounted on an associated fixed cable. Such systems require great lengths of cable and the moving cable is prone to sagging. These systems are also limited to straight line motion between the rotating wheels and any turns in the system have to occur at cable support towers. With existing systems, there is a tendency for the transport means to be pulled off the cable whenever a turn is encountered. As a result, these prior art transmission systems are not designed to negotiate corners. As well, many of the systems where the load is drawn along the support cable by a movable cable are limited in their ability to move up a steep gradient. Prior art clamping systems have been developed that clamp and hold the cable in order to move up a steep incline, however, these systems cause undue cable and clamp wear.

U.S. Pat. No. 3,406,833 to Read discloses a skyline conveying device for harvesting timber composed of individual hoisting units suspended from the skyline. A very long endless drive cable driven by a remote engine is used to move the hoisting units.

U.S. Pat. No. 2,601,228 to Sheilds discloses a hoist system using a cable suspended between two masts. This system also uses an endless drive cable driven by a remote engine. As in the patent to Read, these long endless drive cables are subject to wear and are time consuming to install as a pulley system must be set up to handle the endless cable.

U.S. Pat. No. 1,313,358 to Watkins discloses a tractor for aerial ropeways comprising a travelling carriage with its own power supply. The embodiment of FIG. 8 of this patent shows a endless belt with friction elements for engaging and moving along the aerial ropeway. The friction elements rely on the weight of the device and suspended load to ensure secure engagement with the ropeway and there is a tendency for the device of Watkins to slip.

U.S. Pat. No. 404,499 and 404,500 to Pendelton discloses a gripping device for cable railways that uses an endless belt with gripping elements to grasp a moving cable in order to accelerate the car to which the gripping device is attached to the speed of the cable.

U.S. Pat. No. 3,448,694 to Seyfried teaches a cable gripping device for suspended cable cars that is capable of running along a stationary cable as with present invention. Seyfried employs a relatively crude clamping system for holding and gripping the stationary cable and therefore is very prone to slippage on the cable.

Further examples of prior art cable transmission systems are shown in U.S. Pat. No. 2,132,558 to Braune and U.S. Pat. No. 828,645 to Fouts.

In addition, all the prior art patents discussed above are limited to travelling along essentially straight lengths of cable. They are unable to negotiate tight curves in the cable system on which they move.

Some of the devices of the prior art also suffer from the disadvantage that they employ gripping means for holding the cable or rope way along which they move that bear the entire weight of a transmission and any suspended load. The result is that the cable or rope way is always subject to wear even if there is no slippage of the transmission. If slippage does occur, wear of the cable or rope is even more pronounced.

SUMMARY OF THE INVENTION

The present invention provides a transmission for movement along a track system that addresses the foregoing problems of the prior art. The present invention is intended as an alternative mode of transportation using a track system that will extend the use of stationary suspended cable systems, however, other track systems such as a rail network can also be used with the apparatus of the present invention.

The uses of the present invention in the logging industry provide an indication of the capabilities of the invention, however, it will be understood that the present invention is not limited to applications in the logging industry. Any situation that requires a safe, efficient and reliable transportation system can employ the apparatus of the present invention.

The apparatus of the present invention finds particular application in the logging industry, especially in areas where the terrain is very rugged. In these areas, suspended cable systems are often used instead of ground vehicles to haul logs from a cutting area to a central loading area of further processing. The patents to Read and Shields mentioned above show systems of this type which, unfortunately, are not efficient, safe or particularly versatile. In recent years, helicopter logging has been tried in rugged and difficult to reach areas which are otherwise inaccessible. Helicopters are used to haul logs from such areas suspended beneath the craft from the logging site to a transfer point. Unfortunately, the helicopters are extremely expensive to operate and in this type of logging are only justified for operations where the cost of building access roads to the site would be too great, and erosion damage from building such roads would be unacceptable. At present, as a result of there being no suitable equipment to transport materials safely and inexpensively in rugged areas, vast areas of valuable timber located in such rugged terrain have been left unlogged in favour of more easily accessible timber. Road networks are now being extended onto steeper grades where serious erosion is occurring.

The present invention provides a way for these inaccessible areas to be logged by providing a transmission capable of movement along a stationary cable. By using the transmission to drive a suitable carriage means, logs and other valuable materials can be transported into and out of the forest. In addition, the present invention provides a transportation system for safely handling passengers and materials in any number of work environments.

Accordingly, the present invention provides a transmission for movement along a track system comprising:

- a frame movably supported on said track system by guide means;
- at least one endless belt assembly comprising a pair of spaced endless belt means engaging associated belt wheels mounted to said frame;
- drive means for rotating said belt wheels and driving said endless belt means;
- gripping means adapted for holding and releasing said track system mounted between said pair of spaced endless belt means, said gripping means comprising a plurality of posts extending between said spaced endless belt means over the length of said endless belt assembly with gripping units slidably mounted on each of said posts and biasing means that tend to centre said gripping units on said posts; and
- actuating means for activating said gripping means that defines a gripping region adjacent said track system, said actuating means allowing said gripping means to engage said track system upon entering said gripping region and release said track system on leaving said gripping region whereby said gripping means hold and release said track system in order that said transmission pulls itself along said track system.

The transmission of the present invention can be used on a stationary suspended cable system that is firmly anchored by support members at anchoring locations at spaced intervals along the length of the cable. The gripping means of the present invention are adapted to engage the stationary cable with a non-slip, maximum friction gripping action that fits the lay of the cable. In addition, the gripping means are able to fit about and engage the anchoring locations so that these locations do not interfere with the holding action of the gripping means. In prototype testing, it has been determined that a gripping means of the present invention can grip and hold a vertical stationary cable and support a load that is more than five times the load the gripping unit would be expected to experience in normal use.

The transmission of the present invention is able to efficiently navigate turns in the track system that are of much lower radius than is possible with transport roads. The transmission of the present invention does not have to rely on its own weight to generate positive tractive friction forces thereby significantly reducing wear on the track system.

BRIEF DESCRIPTION OF THE DRAWINGS

Aspects of the various embodiments of the present invention are shown in the enclosed drawings in which.

DESCRIPTION OF THE PREFERRED EMBODIMENTS

Figure 1:
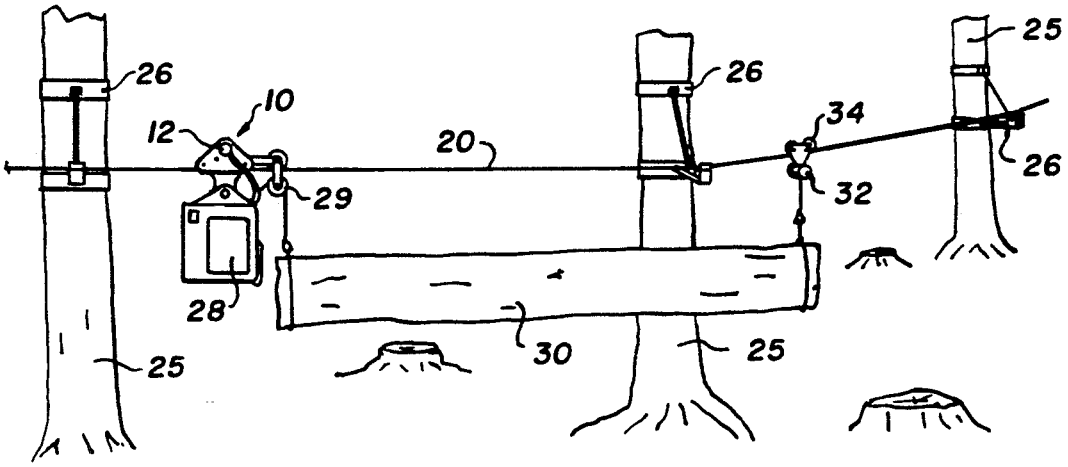
FIG. 1 is a pictorial view of an embodiment of the transmission of the present invention being used to haul a log around a curve.

Referring to FIG. 1, there is shown a track system in the form of a stationary cable 20 suspended between support trees 25 by support members 26. Mounted on stationary cable 20 is transmission 10 according to the present invention beneath which is suspended a suitable motor 28 for supplying the hydraulic pressure necessary to operate the transmission 10 through hydraulic lines 27. Also attached to transmission 10 is a conventional winch unit 29 which supports one end of cut log 30 on suspended stationary cable 20. The other end of log 30 is supported by an optional winch unit 32 mounted beneath a rolling unit 34 that travels along stationary cable 20.

Figure 2:
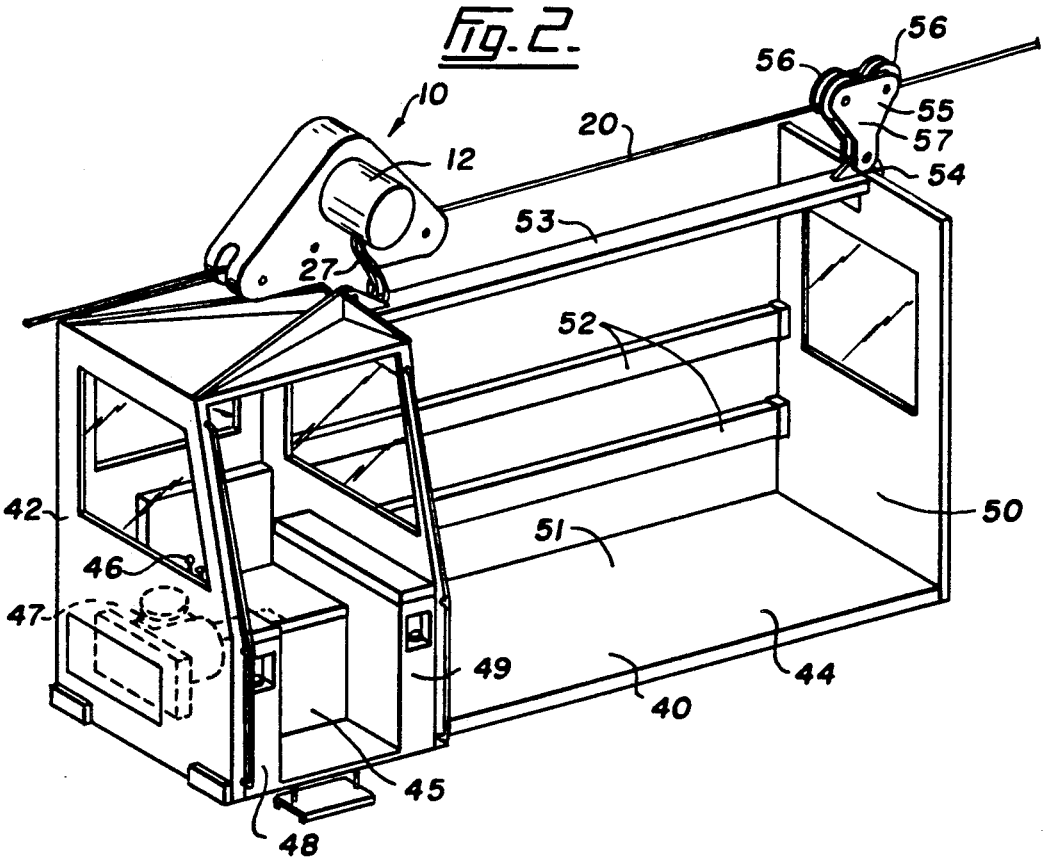
FIG. 2 is a pictorial view of another embodiment of the transmission of the present invention being used to move a transport attachment suitable for moving goods or passengers.

FIG. 2 shows the transmission 10 of the present invention attached to a transport platform 40 suitable for moving materials into or out of a forest harvest area. Transport platform 40 is divided into a control cabin 42 and a cargo area 44. Control cabin 42 comprises an area enclosed on three sides by walls with windows. Within cabin 42, the operator sits in seat 45 where he has easy access to controls 46 for operating transmission 10. Engine 47 shown in dashed lines beneath seat 45 is provided to supply hydraulic power to hydraulic motor 12 of transmission 10 through hydraulic lines 27. Fuel to run engine 47 and hydraulic fluid for the hydraulic lines are stored in tanks 48 and 49 on either side of seat 45. While transmission 10 is equipped with a hydraulic motor 12 in the present embodiment, it will be understood that other drive means such as an internal combustion or electric motor can also be used.

The roof of cabin 42 is provided with an attachment for mounting one end of the transport platform 40 beneath transmission 10. Cabin 42 could be suspended from separate rolling members mounted on the support cable as is shown in FIG. 1. Cargo area 44 is defined by floor 51 that extends between cabin 42 and end wall 50 which is also equipped with a window to allow the operator adequate visibility. Guard rails 52 and upper beam 53 also extend from cabin 42 to end wall 50 and provide rigidity to the entire transport platform structure. At the intersection of upper beam 53 and end wall 50, mounting plate 54 is provided to which is pivotally attached rolling unit 55 which supports the other end of transport platform 40. Rolling unit 55 comprises two sheaves 56 rotatably mounted between essentially T shaped plates 57. Area 44 can be converted from a cargo area to a passenger area, as is done with transport aircraft, in order to carry a party of workers or passengers along suspended stationary cable 20. In addition, cargo area 44 can be used to carry miscellaneous supplies, tree sections such as shake and shingle blocks, and ore or mine concentrates.

Figure 3:
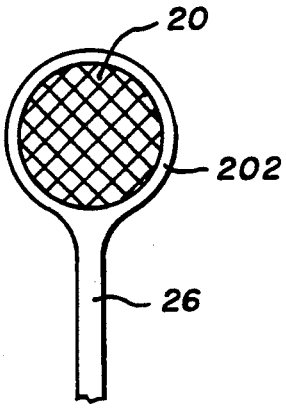
FIG. 3 is a section view through a stationary cable and cable support arm.

Support members are used to grip and locate stationary cable 20 at spaced intervals along the cable to define a pathway along which the transmission of the present invention can move. Such support members are shown at 26 in FIG. 1 extending from trees 25. A detailed view of a support member 26 is shown in FIG. 3. The support member has enclosing arms 202 to firmly hold the cable and prevent it from twisting. Enclosing arms 202 can define a cylindrical cavity in which cable 20 is housed. The cylindrical cavity can extend for some distance along the cable and can be formed with a curve to define a corner in the cable system.

In FIGS. 1 and 2, the same transmission unit 10 is used to pull the log 30 or transport platform 40, along suspended stationary cable 20. A first embodiment of this transmission unit 10 is shown in detail in FIGS. 4 to 6.

Figure 4:
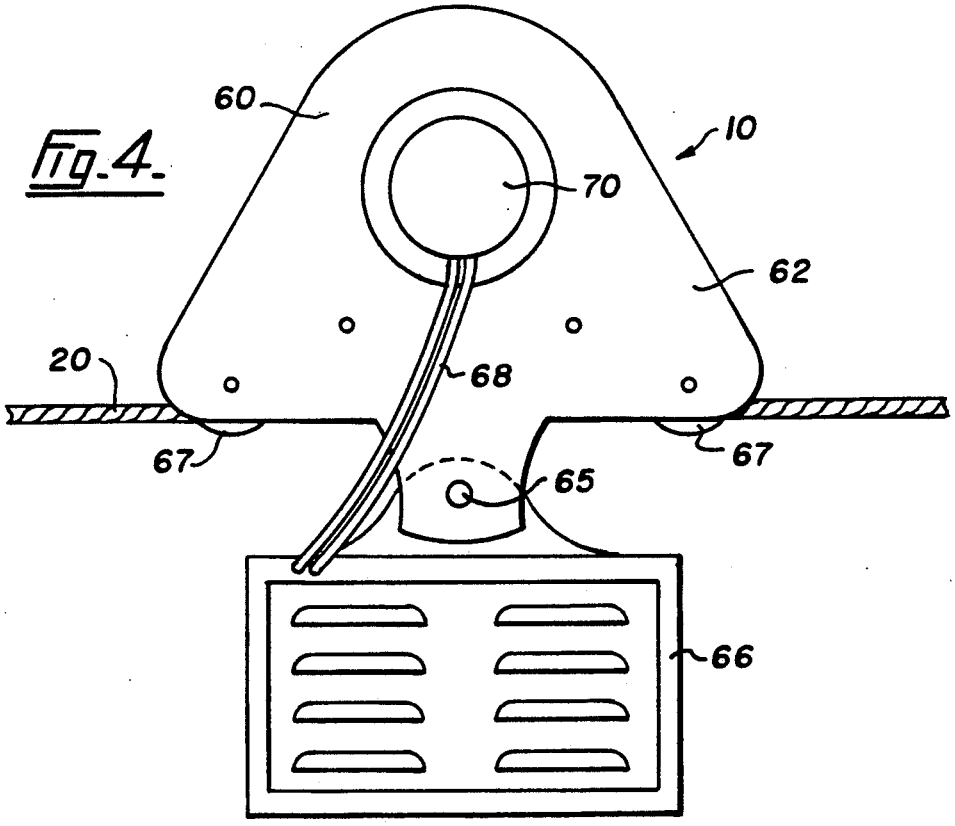
FIG. 4 is a detail side elevation view of the transmission of FIGS. 1 and 2.

Referring to FIG. 4, the transmission 10 comprises a frame 60 movably supported on the track system comprising cable 20. Frame 60 essentially comprises a pair of spaced, parallel plates 62 that are supported on cable 20 by guide means in the form of sheaves 67 mounted between the plates at either end. Pivotally suspended from frame 60 at joint 65 is a suitable motor inside a protective enclosure 66. Protective enclosure 66 is not necessary, but it is desirable to protect the motor from the environment. In the illustrated arrangement of FIG. 4, the motor comprises a conventional gasoline motor connected to a hydraulic pump within enclosure 66. The hydraulic pump supplies fluid under pressure through lines 68 to hydraulic motor 70 which drives the transmission.

Alternatively, frame 60 can support a carriage ember incorporating its own motor as illustrated in FIG. 2. Further, the motor can be suspended beneath its own set of sheaves and be attached to the transmission by a connecting member and suitable hydraulic lines.

Figure 5:
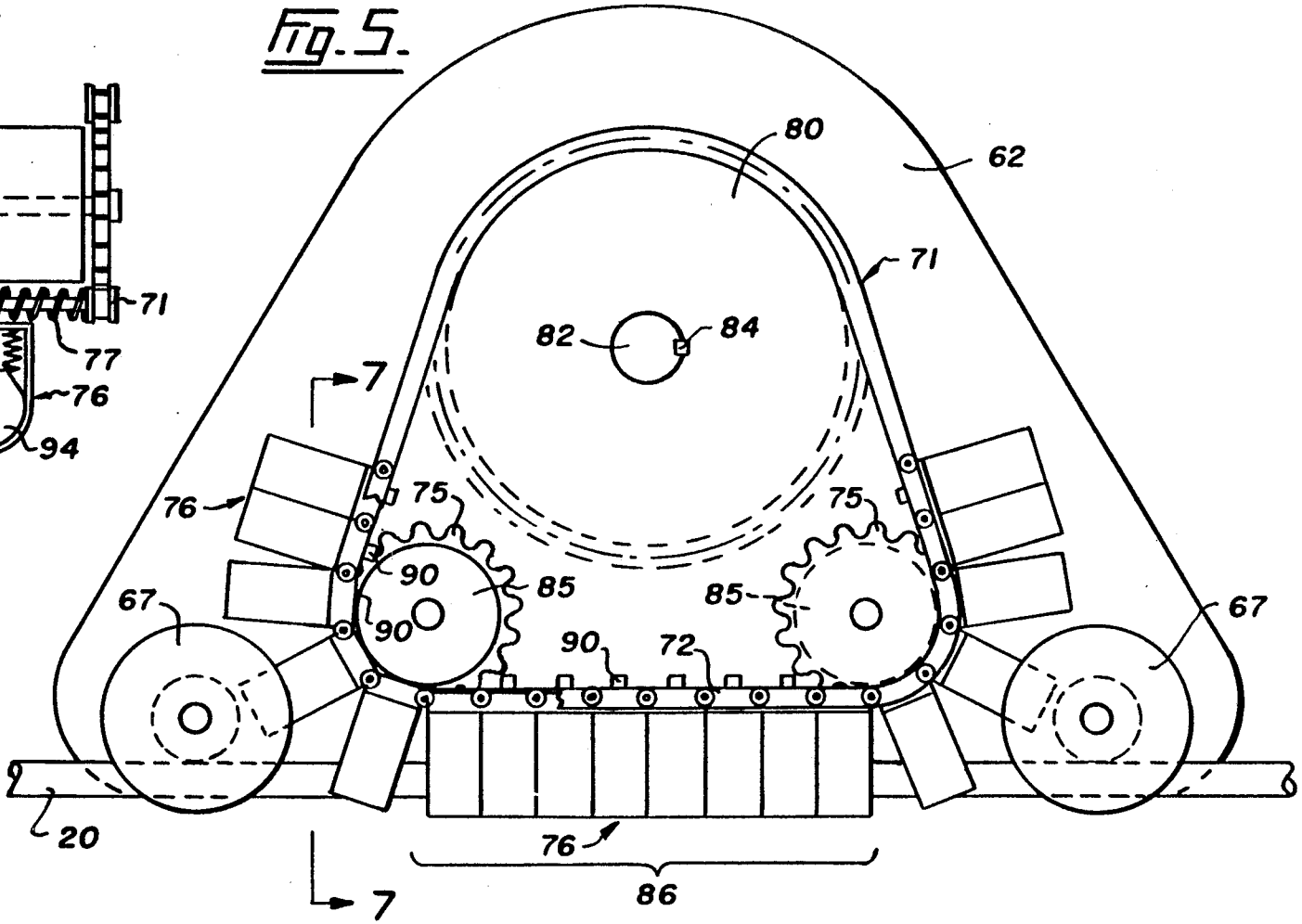
FIG. 5 is a detail side view with cutaway sections of the transmission of FIG. 4.
Figure 6:
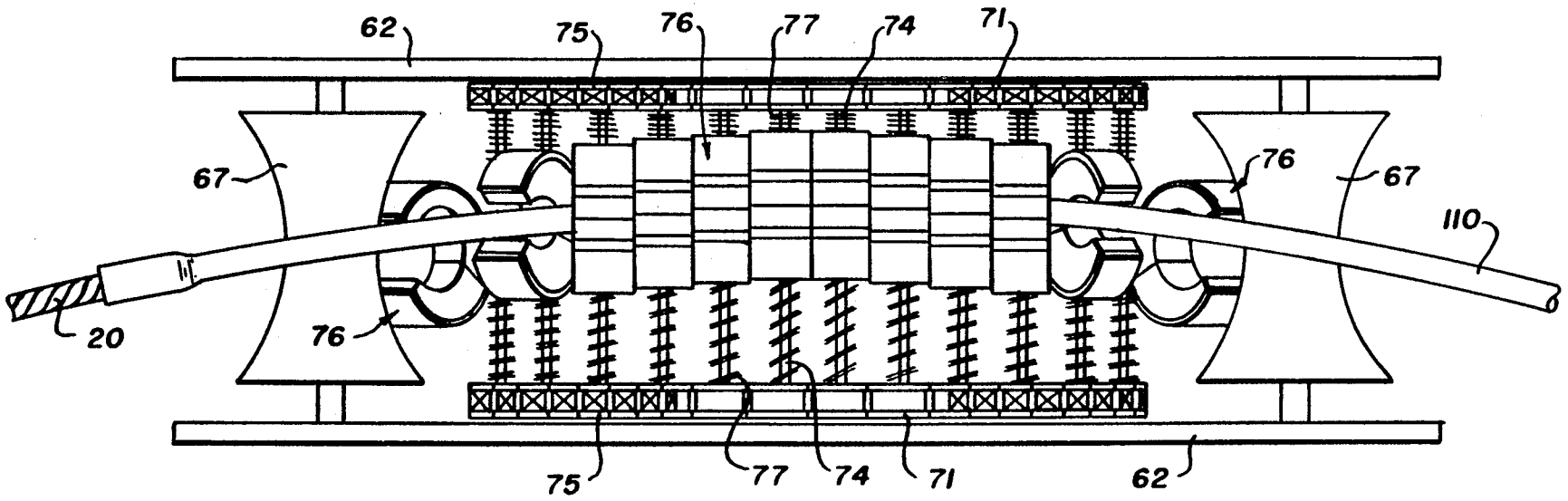
FIG. 6 shows a lower view of the transmission of FIG. 5 looking upwardly to indicate the manner in which the apparatus of the present invention negotiates a corner.

FIG. 5 illustrates a cutaway view of the transmission of the present invention created by removing one of the paired frame plates 62. The transmission includes drive means in the form of paired, spaced central sprockets 80 mounted on rotatable shaft 82 using key 84. Shaft 82 is rotated by hydraulic motor 70. Paired central sprockets 80 drive at least one endless belt assembly 71 comprising a pair of spaced endless belts engaged about sprockets 80 and pairs of belt wheels 75. The paired, spaced nature of the foregoing elements is best shown in FIG. 6 which is a lower view looking upwardly at the apparatus.

In the illustrated embodiment, the endless belts comprise conventional link chains 72. Gripping means adapted for holding and releasing stationary cable 20 as chains 72 are rotated by sprocket 80 are provided between the chains. As best shown in FIG. 6, the gripping means comprise a plurality of posts 74 extending between paired chains 72 over the entire length of the endless belt assembly. Gripping units 76 are slidably mounted on each post and perform the actual holding and releasing function of the transmission. Biasing means in the form of springs 77 are mounted on the posts and act to centre the gripping units 76 that are slidably mounted on the posts. This arrangement of the gripping means on posts 74 permits the transmission of the present invention to negotiate changes in direction in the track system on which it is running.

A number of gripping units have been developed for use with the transmission of the present invention as illustrated in FIGS. 8 through 12. The gripping units act to hold and release the cable in succession in order that the transmission pulls itself along the cable.

In general, the various embodiments of the gripping units include a pair of opposed gripping arms having gripping surfaces and movable between a default gripping position in which the opposed arms engage and hold the cable from opposite sides and a released position in which the gripping arms are free of cable 20. Actuating means are provided for operating the gripping units to co-ordinate their engagement and release of the stationary cable 20 such that the transmission moves along the cable. In one embodiment, the gripping surfaces are in their released position only when depressible button means associated with each unit are depressed by the actuating means. The actuating means define a gripping region adjacent cable 20 and allow the gripping units to engage cable 20 on entering the gripping region and release the cable on leaving the gripping region such that the gripping units hold and release the cable in order that the transmission pulls itself along the cable.

Figure 7:
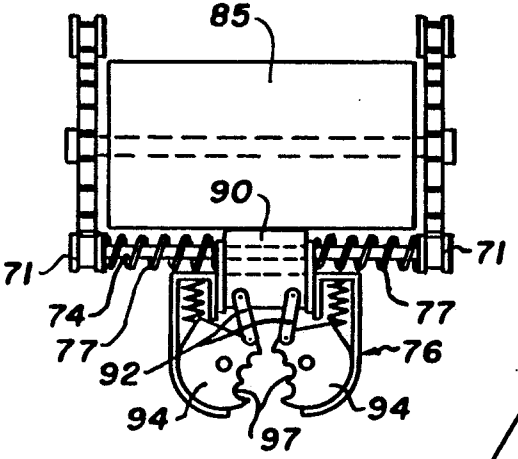
FIG. 7 is a detail view of the mounting of one of the gripping units to allow for movement around corners taken along line 7—7 of FIG. 5.

The actuating means comprise a pair of rollers 85 associated with belt wheels 75 as best shown in FIG. 7 which is a front view of the transmission taken along line 7—7 of FIG. 5. The rollers 85 define a gripping region 86 (FIG. 5) adjacent cable 20. As will be more fully described, rollers 85 engage depressible button means associated with each of the gripping units 76 adapted to move the gripping arms between their gripping and released positions. This allows the gripping units to engage cable 20 on entering gripping region 86 and release the cable on leaving the gripping region such that the gripping units hold and release the cable in order that the transmission pulls itself along the cable.

Figure 8:
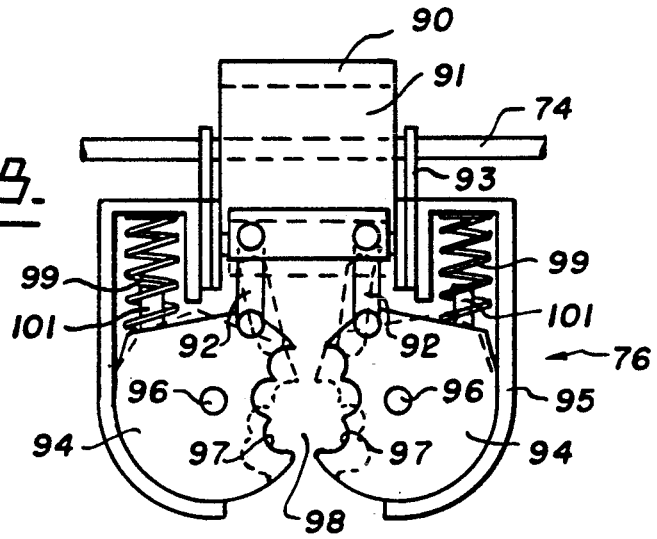
FIG. 8 is section view through an individual gripping unit.
Figure 9:
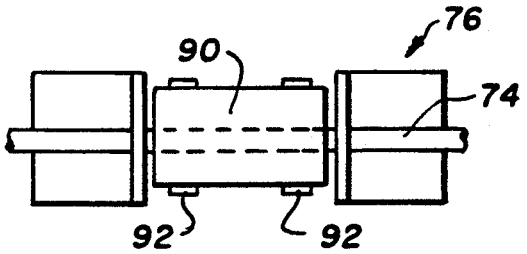
FIG. 9 is a plan view of the gripping unit of FIG. 8.

By way of example, FIGS. 8 and 9 show a cross-section and a plan view, respectively, of a first embodiment of a gripping unit 76 having depressible button means including a projecting push button 90 having connecting links 92 extending between the push button and each of a pair of gripping arms 94. Push button 90 is formed with a slot 91 therethrough to accommodate post 74. The gripping unit is formed from a pair of opposed housings 95 adapted for slidable mounting on posts 74 by way of flanges 93. Rotatably mounted within each housing about shaft 96 is essentially cylindrical gripping arm 94 having a gripping surface 97 formed by cutting out a semi-cylindrical perimeter portion. The two cutout perimeter portions cooperate to define a cavity 98 through which the stationary cable 20 passes. Connecting links 92 are pivotally attached to an upper edge of each gripping arm 94 and resilient biasing means comprising a spring 99 is located at the opposite upper edge by means of locating post 101. Spring 99 acts between housing 95 and gripping arm 94 and causes gripping arm 94 to rotate to the position shown by solid lines in FIG. 8. This is the gripping position of the gripping unit, and the unit defaults to this position when push button 90 is not depressed. When gripping arms 94 are in their gripping position, push button 90 is raised upwardly by connecting links 92 to project above the gripping unit.

As paired chains 72 are rotated by drive sprocket 80 about belt wheels 75, each gripping unit 76 must pass by rollers 85. Referring to FIG. 7, as a gripping unit passes by a roller 85, upwardly projecting push button 90 is depressed by the roller. At the start of gripping region 86, depressing button 90 causes gripping arms 94 to pivot to the released position shown in dashed lines in FIG. 8 and opens up receiving cavity 98 so that the cavity may fit about the stationary cable. Once the gripping unit passes roller 85, springs 99 bias gripping arms 94 into the gripping position and move push button 90 upwardly. The stationary cable is firmly held by all gripping units in the gripping region. The arrangement of gripping arms 94 is such that the cable is effectively locked into place and any attempt to remove the cable without depressing button 90 involves overcoming the force of springs 99. At the end of gripping region 86, roller 85 again depresses push button 90 to pivot the gripping arms 94 to the released position and allow the gripping unit to release the cable as the unit is raised away from the cable as it passes about the belt wheel 75.

Mounting each of the gripping units of the present invention on a post member 74 allows the transmission of the present invention to freely navigate sharp bends in the cable on which it is travelling. FIG. 6 indicates how the transmission of the present invention is able to negotiate a curve in the cable system. Any change in direction of the cable system is formed by a rigid rod turn section 110 that is bent into the desired turn radius. Rigid rod section 110 is connected between straight sections of suspended cable that define the entrance and exit to the turn section. Alternatively, as previously illustrated in FIG. 3, rigid rod section 110 can be a hollow cylindrical section through which cable 20 passes. Sheaves 67 are free to ride over the turn section since they are of considerable width. The gripping unit 76 are free to move independently of each other along post members 74 to keep themselves aligned themselves with the rigid rod turn section which they are gripping. After exiting the turn section, springs 77 act to re-centre the gripping units on their respective post members.

Figure 10:
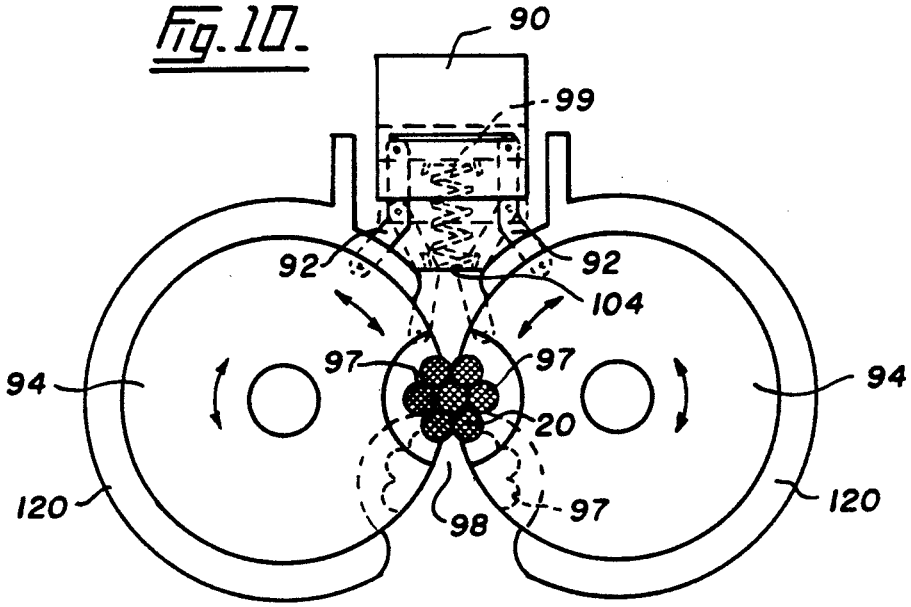
FIG. 10 is a section view of an alternative gripping unit.
Figure 11:
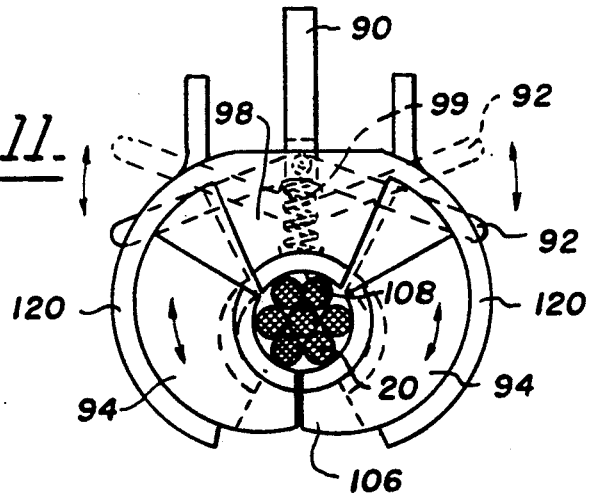
FIG. 11 is a section view through a further alternative gripping unit.
Figure 12:
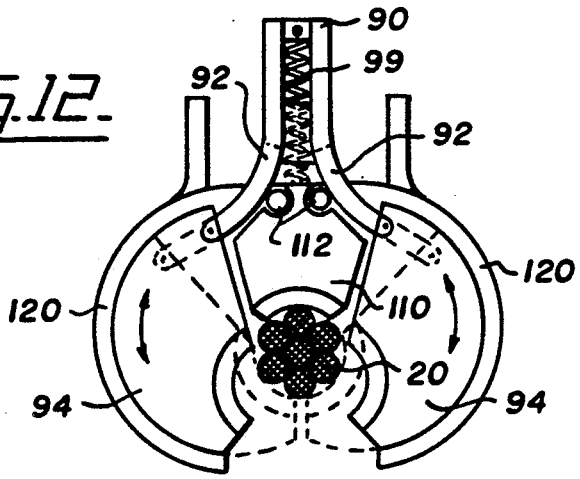
FIG. 12 is a section view of a still further alternative gripping unit.

The alternative gripping units of FIGS. 10 to 12 also employ opposed gripping arms that are activated by a depressible button means that can be used with the transmission of the present invention. In fact, different gripping units can be mounted onto adjacent post members 74. In each of the alternative gripping units, similar elements have the same reference numbers.

FIG. 10 is a cross-sectional view that shows a gripping unit that comprises a pair of semi-cylindrical housings 120 adapted for slidable mounting on posts 74. Within each housing 120, there is a gripping arm 94 rotatably mounted about shaft 96. Each gripping arm 94 is an essentially cylindrical member having a cutout perimeter portion defining a cavity that is lined with a gripping surface 97. The rotatable gripping surface is formed with indentations that correspond to the strands of a cable to be gripped. Together, the cutout portions of the gripping arms co-operate to define a cavity 98 to accept and hold the stationary cable when the gripping arms 94 are rotated to the gripping position shown by solid lines in FIG. 10. Protruding push button 90 is mounted atop a centrally located spring 99 which rests on a base plate 104 straddling the semi-cylindrical housings 120. Connecting links 92 are pivotally connected at opposite ends to push button 90 and gripping arms 94. Normally, push button 90 is biased upwardly such that gripping arms 94 are rotated into the gripping position. When push button 90 is depressed by a roller 85, links 92 and gripping arms 94 move to the positions shown by dashed lines, opening up receiving cavity 98 to accept and subsequently engage stationary cable 20. Gripping surfaces 97 are mounted to pivot with respect to the gripping arm to make it possible for these surfaces to automatically pivot to an appropriate position when engaging the strands of cable 20 thereby accommodating any minor twists in the cable and ensuring a secure grip. In fact, it is preferable that all the various embodiments of the gripping units of the present invention are equipped with these rotatable gripping surfaces to allow for secure engagement of a cable, particularly in the case of a cable that is supported by support arms at intervals of greater than 100 meters. Such a cable has a tendency to twist between supports, and the rotatable gripping surfaces of the present invention accommodate any twisting.

FIG. 11 shows a further alternative gripping unit comprising an essentially cylindrical housing 120 slidably mountable on post 74. A lower slot 106 is provided to accept cable 20. A pair of opposed gripping arms are positioned in the cylindrical housing for movement between a gripping position and a released position. Each gripping arm comprises an arcuate member 94 whose outer perimeter slidably engages the inner surface of cylindrical housing 120 and whose inner perimeter defines a rotatable gripping surface 97. A third stationary arcuate gripping member is rigidly mounted to housing 120 at the top centre but has a lower rotatable gripping surface 108. Together, the three gripping surfaces define a central gripping cavity 98 to engage and hold a stationary cable. Gripping surface 108 is formed with a central cavity in which push button 90 and spring 99 are housed. A pair of connecting links 92 are pivotally attached at point 10 to button 90 and extend to each arcuate gripping arm 94. Normally spring 99 biases button 90, connecting links 92 and gripping arms 94 into the gripping position shown by solid lines in FIG. 11. When button 90 is depressed, the various elements move to the positions shown by dashed lines thereby placing the gripping arms 94 in a released position.

FIG. 12 shows a still further alternative gripping unit which is very similar to the gripping unit of FIG. 11. The gripping unit of FIG. 12 uses a push button arrangement whereby arcuate gripping arms 94 are normally held in the released position as shown by solid lines as opposed to being held normally in the gripping position as with the previous embodiments. Push button 90 is pivotally connected to the ends of a pair of J shaped links 92 that extend downwardly and outwardly to arcuate gripping arms 94. The opposite end of each link is pivotally connected to arcuate gripping arms 94. When push button 90 is depressed by roller 85, spring 99 is compressed and gripping arms 94 move to the gripping position as shown by dashed lines. Once push button 90 is released, spring 99 causes gripping arms 94 to rotate to their released positions. Therefore, with the gripping unit of FIG. 12, gripping of the stationary cable occurs only when push button 90 is depressed. Central stationary gripping surface 110 is provided with roller bearings 112 on which connecting links 92 roll to ensure the links move smoothly outwardly and downwardly.

Figure 13:
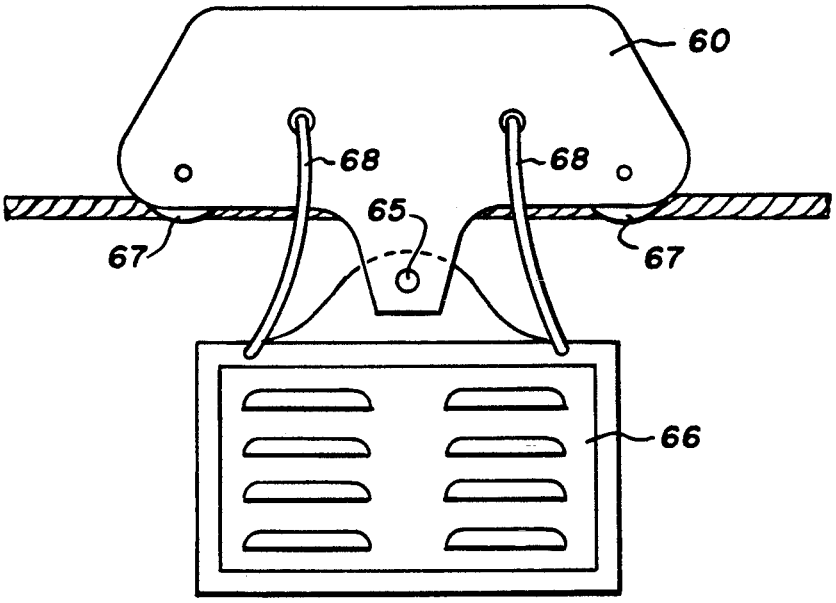
FIG. 13 is a detail side elevation view of an alternative embodiment of the transmission of the present invention.
Figure 14:
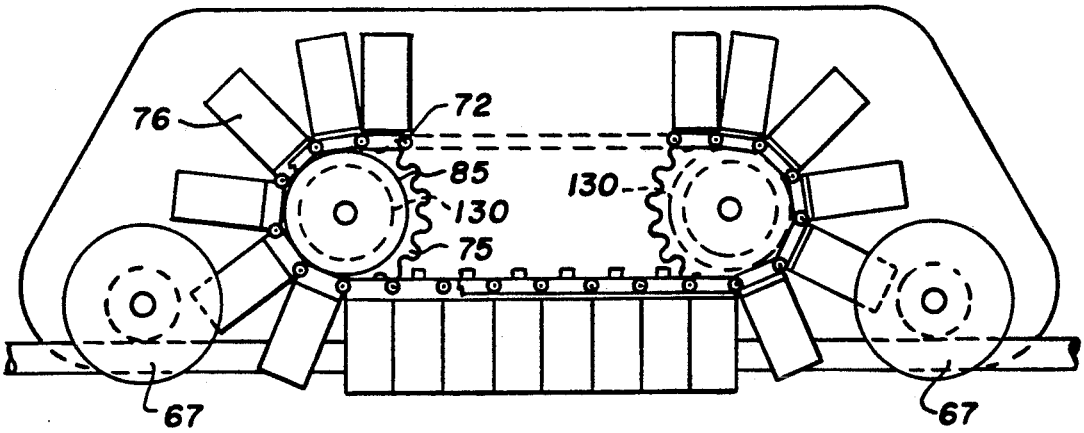
FIG. 14 is a detail side view with cutaway section of the alternative embodiment of FIG. 13.

An alternative embodiment of the present invention is illustrated in FIGS. 13 and 14. This embodiment is very similar to that of FIGS. 4 and 5, and analogous parts have been identically labelled. The present embodiment differs from the first embodiment in that it provides a more compact transmission that avoids the use of drive sprockets to rotate belt wheels 75. Instead, hydraulic motors 130 are mounted within each roller 85 to drive the belt wheels 75. Chains 72 are looped about belt wheels 75. Suspended from frame 60 at joint 65 is a suitable motor inside a protective enclosure 66. The motor comprises a conventional gasoline motor connected to a hydraulic pump within enclosure 66. The hydraulic pump supplies fluid under pressure through lines 68 to hydraulic motor 130 in order to drive the transmission.

Although the present invention has been described in some detail by way of example for purposes of clarity and understanding, it will be apparent that certain changes and modifications may be practised within the scope of the appended claims.

I claim:

1. A transmission for movement along a track system comprising:

a frame movably supported on said track system by guide means;

at least one endless belt assembly comprising a pair of spaced endless belt means engaging associated belt wheels mounted to said frame;

drive means for rotating said belt wheels and driving said endless belt means;

gripping means for holding and releasing said track system, said gripping means mounted between said pair of spaced endless belt means, said gripping means comprising a plurality of posts extending between said spaced endless belt means over the length of said endless belt assembly with gripping units slidably mounted on each of said posts and biasing means that tend to centre said gripping units on said posts; and actuating means for activating said gripping means that defines a gripping region adjacent said track system, said actuating means allowing said gripping means to engage said track system upon entering said gripping region and release said track system on leaving said gripping region whereby said gripping means hold and release said track system in order that said transmission pulls itself along said track system.

2. A transmission as claimed in claim 1 in which said track system comprises a stationary suspended cable.

3. A transmission as claimed in claim 2 in which said guide means to support said frame on said stationary cable comprises sheaves rotatably mounted to said frame.

4. A transmission as claimed in claim 2 in which said stationary cable is supported at spaced intervals along the length of the cable by support members.

5. A transmission as claimed in claim 4 in which changes in direction in said suspended cable system are formed by rigid turn sections bent into the desired turn direction and connected between straight sections of suspended cable that define an entrance and an exit to the turn section.

6. A transmission as claimed in claim 1 in which each of said gripping units includes opposed gripping arms with gripping surfaces movable between a gripping position in which said opposed arms engage and hold said track system from opposite sides and a released position in which said gripping arms are free of said track system.

7. A transmission as claimed in claim 6 in which said actuating means comprises:

a pair of rollers situated before and after said gripping region; and depressible button means attached to said gripping units to move said gripping arms between said gripping position and said released position when acted on by said rollers.

8. A transmission as claimed in claim 7 in which said depressible button means comprises a push button, connecting links extending between said push button and each of said gripping arms, and resilient biasing means acting on said push button.

9. A transmission as claimed in claim 7 in which said depressible button means acts to position said gripping arms in said gripping position when not being acted on by said rollers.

10. A transmission as claimed in claim 7 in which said depressible button means acts to position said gripping arms in said released position when not being acted on by said rollers.

11. A transmission as claimed in claim 6 in which each of said gripping units includes a pair of opposed semicylindrical housings, a gripping arm rotatably mounted in each housing comprising an essentially cylindrical member with a gripping surface comprising a cutout perimeter portion of said cylindrical member, said cutout perimeter portions co-operating to define a cavity to accept and hold said track system when said gripping arms are rotated to said gripping position.

12. A transmission as claimed in claim 6 in which each of said gripping units includes an essentially cylindrical housing having a slot to accept said track system, a pair of opposed gripping arms rotatably mounted in said cylindrical housing comprising a pair of arcuate members having gripping surfaces, said gripping surfaces defining a cavity to accept and hold said track system when said gripping arms are rotated to said gripping position.

13. A transmission as claimed in claim 12 including a stationary arcuate gripping surface between said opposed arcuate gripping arms whereby said gripping surfaces of said gripping arms and said stationary gripping surface cooperate to define a three surface cavity that encloses and holds said track system when said gripping arms are rotated to the gripping position.

14. A transmission as claimed in claim 7 in which said depressible button means comprises a push button, connecting links extending between said push button and each of said gripping arms, and resilient biasing means acting on said gripping arms to bias said gripping arms in a gripping position.

15. A transmission as claimed in claim 14 in which each of said gripping units includes a pair of opposed semicylindrical housings, a gripping arm rotatably mounted in each housing comprising an essentially cylindrical member with a gripping surface comprising a cutout perimeter portion of said cylindrical member, said gripping surfaces defining a cavity to accept and hold said track system when said gripping arms are rotated to said gripping position.

16. A transmission as claimed in claim 14 in which each of said gripping units includes an essentially cylindrical housing having a slot to accept said track system, a pair of opposed gripping arms rotatably mounted in said cylindrical housing comprising a pair of arcuate members having gripping surfaces, said gripping surfaces defining a cavity to accept and hold said track system when said gripping arms are rotated to said gripping position.

17. A transmission as claimed in claim 16 including a stationary arcuate gripping surface between said opposed arcuate gripping arms whereby said gripping surfaces of said gripping arms and said stationary gripping surface cooperate to define a three surface cavity that encloses and holds said track system when said gripping arms are rotated to the gripping position.

18. A transmission as claimed in claim 6 in which said gripping surfaces are pivotally mounted to said gripping arms.

19. A transmission as claimed in claim 18 in which said track system comprises a cable, said pivotable gripping surfaces are formed with indentations that correspond to strands of said cable.

20. A transmission as claimed in claim 7 in which said drive means comprises a motor mounted within at least one of said rollers for driving one of said belt wheels.

* * * * *